US011465381B2

(12) United States Patent
Meyer

(10) Patent No.: US 11,465,381 B2
(45) Date of Patent: Oct. 11, 2022

(54) PRESS

(71) Applicant: Gebr. Schmidt Fabrik für Feinmechanik GmbH & Co. KG, St. Georgen (DE)

(72) Inventor: Andreas Leo Meyer, Furtwangen (DE)

(73) Assignee: GEBR. SCHMIDT FABRIK FÜR FEINMECHANIK GMBH & CO. KG, St. Georgen (DE)

( * ) Notice: Subject to any disclaimer, the term of this patent is extended or adjusted under 35 U.S.C. 154(b) by 141 days.

(21) Appl. No.: 16/870,205

(22) Filed: May 8, 2020

(65) Prior Publication Data

US 2020/0269537 A1 Aug. 27, 2020

Related U.S. Application Data

(63) Continuation of application No. PCT/EP2019/064375, filed on Jun. 3, 2019.

(30) Foreign Application Priority Data

Jun. 12, 2018 (DE) ..... 10 2018 114 029.0

(51) Int. Cl.
*B30B 15/04* (2006.01)
*B30B 1/18* (2006.01)

(52) U.S. Cl.
CPC ..... *B30B 15/045* (2013.01); *B30B 1/181* (2013.01); *B30B 15/041* (2013.01)

(58) Field of Classification Search
CPC ..... B30B 15/04; B30B 15/041; B30B 15/045; B30B 1/18; B30B 1/181
(Continued)

(56) References Cited

U.S. PATENT DOCUMENTS 3,204,550 A 9/1965 Swiderski
3,727,546 A * 4/1973 McKinney ..... B30B 9/3064 100/229 A
(Continued)

FOREIGN PATENT DOCUMENTS

CN 2067217 U 12/1990
CN 102259154 A 11/2011
(Continued)

OTHER PUBLICATIONS

English Translation of International Preliminary Report On Patentability issued for PCT/EP2019/064375 dated Dec. 15, 2020.
(Continued)

*Primary Examiner* — Jimmy T Nguyen
(74) *Attorney, Agent, or Firm* — Reising Ethington, P.C.

(57) ABSTRACT

A press including a drive train having a motor and a press ram, and a housing having a first base plate, a second base plate and at least three columns arranged therebetween. The columns connect the two base plates to one another and keep them spaced apart. A first opening is arranged in the first base plate and a second opening is arranged in the second base plate. At least a part of the motor is arranged on a first side of the first base plate facing away from the columns and at least a part of the press ram is arranged on a second side of the second base plate facing away from the columns. The motor and the press ram are interconnected through the first and second openings.

10 Claims, 7 Drawing Sheets

(58) Field of Classification Search
USPC ..... 100/230, 287, 289
See application file for complete search history.

(56) References Cited

U.S. PATENT DOCUMENTS

| | | | | | |
|---|---|---|---|---|---|
| 3,842,652 | A * | 10/1974 | Yonezawa | B30B 1/22 | 72/454 |
| 4,036,152 | A * | 7/1977 | Bright | F23G 5/027 | 110/191 |
| 4,068,514 | A * | 1/1978 | Chachin | B21D 26/12 | 72/454 |
| 4,627,266 | A * | 12/1986 | Siebold | B30B 1/188 | 192/103 C |
| 7,293,500 | B2 * | 11/2007 | Futamura | B30B 1/186 | 100/49 |
| 7,562,594 | B2 | 7/2009 | Nagai et al. | | |
| 8,601,943 | B2 * | 12/2013 | Yang | B30B 15/041 | 100/102 |
| 2013/0291609 | A1 * | 11/2013 | Furukawa | B30B 1/18 | 72/21.4 |

FOREIGN PATENT DOCUMENTS

| | | | | |
|---|---|---|---|---|
| CN | 205798279 | U | 12/2016 | |
| CN | 205853393 | U | 1/2017 | |
| DE | 824164 | C | 12/1951 | |
| DE | 3733781 | A1 | 4/1989 | |
| DE | 102005037475 | A1 | 3/2006 | |
| EP | 1865225 | A1 | 12/2007 | |
| EP | 1880836 | A1 | 1/2008 | |
| JP | H0437400 | A | 12/1992 | |
| JP | 07009200 | A | 1/1995 | |
| JP | 3135269 | U | 9/2007 | |
| WO | 2009/073240 | A1 | 6/2009 | |
| WO | WO2009073240 | A1 | 6/2009 | |
| WO | 2011/0366690 | A1 | 3/2011 | |
| WO | 2013/050267 | A1 | 4/2013 | |
| WO | 2013/186196 | A1 | 12/2013 | |
| WO | 2017/068375 | A1 | 4/2017 | |
| WO | WO-2017186161 | A1 * | 11/2017 | H01L 21/68785 |

OTHER PUBLICATIONS

Office action issued by the China National Intellectual Property Administration for application 201980006430.5 dated Jul. 5, 2021.
English Translation of the Office action issued by the China National Intellectual Property Administration for application 201980006430.5 dated Jul. 5, 2021.
International Search Report issued for PCT/EP2019/064375 dated Oct. 9, 2019.
Examination report issued by the Japanese Patent Office for application 2020-552148; dated Jul. 27, 2021.
English Translation of the Examination report issued by the Japanese Patent Office for application 2020-552148; dated Jul. 27, 2021.

* cited by examiner

PRESS

CROSS REFERENCE TO RELATED APPLICATIONS

This application is a continuation of international patent application PCT/EP2019/064375, filed on Jun. 3, 2019 designating the U.S., which international patent application has been published in German language and claims priority from German patent application DE 10 2018 114 029.0, filed on Jun. 12, 2018. The entire contents of these priority applications are incorporated herein by reference.

BACKGROUND OF THE INVENTION

This disclosure relates to a press which is preferably used as a joining press.

Press and joining processes are an important part of modern assembly technology. For such applications, a large number of different, already known press systems are available. In addition to pneumatic and hydraulic press systems, servo press systems (hereinafter referred to as "servo presses") are taking up an increasing share.

In servo presses, torque, speed and path information are transferred to mechanical components by means of a controllable motor. These mechanical components within the drive train can, for example, comprise a rack and pinion drive or a spindle drive (trapezoidal, ball, roller or planetary roller screw drive). Thereby, the rotary motion of the motor (e.g. electric motor) is converted into a linear motion. The level of motor torque determines the feed force (press force) of the linear movement.

To be able to absorb this press force, each of these press systems requires a housing. In this housing, bearings are typically inserted which absorb the axial forces generated by the mechanical components. It is advantageous for press processes if the housings have a high rigidity. A high housing rigidity is a prerequisite for precise, reproducible press processes.

In many cases, an extruded aluminum profile is used for the housing. Such extruded profiles can be designed in a cost-effective and functional way. The disadvantage of aluminum extrusion profiles, however, is their relatively low modulus of elasticity (modulus of elasticity approx. 70,000 $N/m^2$).

Housing profiles made of steel, on the other hand, have a higher modulus of elasticity (approx. 210,000 $N/m^2$) than aluminum, but for the most part are limited to standardized round tubes. This considerably limits the constructive design possibilities. A further problem with steel tubes is the attachment of the bearing plates which are usually arranged at the ends. Here a connection with high strength must be realized. Steel plates are often welded to the ends of the steel tubes. However, this involves the risk of distortion of the bearing plates or the steel tubes. Further finishing is often difficult and cost-intensive.

A further frequently occurring disadvantage of press housings is the fact that, when a closed housing is used, access to the internal components, e.g. to parts of the drive train, is almost impossible.

It is often also necessary to secure parts of the drive train against rotation on the housing. In the case of closed housing forms such as aluminum extrusions or steel tubes, it is technically very complex to provide an anti-rotation protection in the interior of the press housing. For this reason, a slot is often made in the outer shell of the press housing parallel to the central or longitudinal axis of the press housing. This slot can be used as an rotation lock and at the same time as a linear guide for parts of the drive train. However, the disadvantage of introducing such a slot into the outer shell of the press housing is that the torsional rigidity of the housing structure is significantly reduced thereby.

SUMMARY

It is an object to provide a press with an improved housing design that overcomes the above-mentioned disadvantages. In particular, it is an object to provide a housing structure with a high rigidity and a high torsional stiffness, while at the same time facilitating access to the interior of the housing.

According to an aspect, a press is provided that comprises:

- a drive train comprising a motor and a press ram; and
- a housing that comprising a first base plate, a second base plate and at least three columns arranged between the two base plates, wherein the columns connect the two base plates to one another and keep them spaced apart, wherein a first opening is arranged in the first base plate and a second opening is arranged in the second base plate,
  - wherein at least a part of the motor is arranged on a first side of the first base plate facing away from the columns and at least a part of the press ram is arranged on a second side of the second base plate facing away from the columns, and wherein the motor and the press ram are interconnected through the first and second openings,
  - wherein the press ram protrudes through the second opening out of the second base plate, and wherein a press plunger is arranged at an end face of the press ram or the press plunger is formed by said end face, said end face being disposed on the second side of the second base plate.

The columnar design allows producing a housing with very high rigidity and at the same time high torsional stiffness. The space between the columns allows easy access to the drive train, which is at least to a large extent located between or surrounded by the columns. Repairs or replacement of parts of the drive train can therefore be carried out very easily. The high stiffness and torsional strength of the housing enables very precise and reproducible press processes.

The housing design should not be confused with the classic housing design of a forming press with column guidance. In forming presses with column guide, the columns are used for axial guidance of the press plunger, wherein the press plunger is moved axially along the columns. The press force exerted by the press plunger is therefore transmitted via or by means of the column guide in such forming presses.

In the case of the herein presented press, however, the force transmission of the press force is preferably not effected via the housing. The housing is preferably used as support for the motor and axial guidance of the press ram. The power transmission in the axial direction is preferably effected via the drive train itself. The two base plates do not move. The base plates are permanently kept at a constant distance from each other by the columns. The movement of the press ram is relative to the two base plates, preferably orthogonal to them.

In both base plates there is one opening each, wherein the opening in the first base plate is hereinafter for better differentiation referred to as the first opening and the opening in the second base plate is hereinafter referred to as the second opening. The motor and the press ram are interconnected through these two openings. The drive train is therefore passed through both openings.

The motor is arranged at least partially above the first opening on the top side of the first base plate which faces away from the columns. The press ram, on the other hand, is arranged at least partially below the second opening on the underside of the second base plate which faces away from the columns. The press ram therefore protrudes downwards through the second opening out of the second base plate, so that the press process takes place below, i.e. on the side of the second base plate which faces away from the columns. Instead, in forming presses with a column guide the press process typically takes place between the two base plates, which then serve as the press plunger.

The press plunger is arranged at the end face (lower end) of the press ram, which press plunger presses on the workpiece to be processed during the press process. The press ram is thus arranged outside the housing built by the columns and the two base plates. However, in an alternative refinement, the lower end of the press ram itself may be used as the press plunger.

According to a further refinement, the at least three columns each extend along a longitudinal axis that is oriented transversely, preferably orthogonally, to the first and second base plates.

The term "transversely" in this case means any orientation that is not parallel. The term "transversely" thus includes orthogonal, but is not limited to it.

For example, the at least three columns can be arranged at an acute angle relative to the two base plates. Preferably the at least three columns have the same orientation relative to the first base plate and the same orientation relative to the second base plate. This means that each of the columns is oriented at a first angle to the first base plate, which is the same for all columns, and each of the columns is oriented at a second angle to the second base plate, which is the same for all columns. Particularly preferably, all columns are aligned orthogonally to the two base plates.

According to another refinement, at least part of the drive train is arranged between the two base plates and is surrounded by the at least three columns.

In other words, a part of the drive train is arranged in a space that is defined in the axial direction by the two base plates and in the radial direction by the at least three columns. By this part of the drive train is meant in particular that part of the drive train which is located between the motor and the press ram and which transmits the force from the motor to the press ram.

Preferably, the first and second openings extend along a central axis, wherein a first lateral surface of the first opening and a second lateral surface of the second opening are each at a smaller distance from the central axis than the at least three columns.

The columns are thus arranged radially further outward and surround the two openings, so to speak. It is preferred that the two openings are aligned with each other. In this refinement, the drive train extends along the central axis so that it is arranged centrally in the housing and surrounded by the columns. The at least three columns may each be arranged at the same distance from the central axis.

According to another refinement, the drive train comprises a spindle drive having a spindle and a spindle nut.

The spindle drive can be designed as a trapezoidal, ball, roller or planetary roller screw drive, for example. Other such drives, in which a spindle and a spindle nut are moved relative to each other and which serve to transfer a rotational movement into a linear, translational movement, can also be used here and are to be understood as spindle drives in the present sense, irrespective of their detailed design and the type and geometric shape of the active bodies (spindle and spindle nut).

The spindle drive preferably comprises a component which is rotationally driven by the motor and a translationally moved component which is coupled to the rotationally driven component and which is translationally guided and secured against rotation on at least one of the at least three columns by means of a guide, wherein either (i) the spindle is the rotationally driven component and the spindle nut is the translationally moved component or (ii) the spindle is the translationally moved component and the spindle nut is the rotationally driven component.

Both variants (i) and (ii) thus concern the use of a spindle drive with a spindle driven by the motor (variant (i)) or the use of a spindle drive with a spindle nut driven by the motor (variants (ii)).

If a spindle drive with a driven spindle is used, the spindle nut is coupled or connected to the press ram, so that the spindle nut is moved translationally together with the press ram in the axial direction, i.e. preferably perpendicular to the two base plates, during a press process.

If a spindle drive with a driven spindle nut is used, the spindle is coupled or connected to the press ram so that the spindle is moved translationally in the axial direction together with the press ram during a press process.

In both cases, the rotationally driven component is driven by the motor, whereas the translationally moved component is coupled to the press ram and moves together with it, preferably synchronously. In this way, very high axial forces can be generated and transmitted to the workpiece to be machined with relatively low energy expenditure.

The guide, by means of which the translationally moved component of the spindle drive is translationally guided on at least one of the at least three columns and secured against rotation, preferably comprises a bearing.

In a further refinement, the bearing comprises two rollers which are configured to roll on the at least one of the at least three columns, wherein the two rollers are each connected to the translationally moved component.

Preferably, the first of the two rollers comprises a first wheel, which is pivoted on a first axle, which is fixedly connected to the translationally moved component of the spindle drive. Likewise, the second of the two rollers comprises a second wheel which is pivoted on a second axle which is fixedly connected to the translationally moved component of the spindle drive.

The first and second axles are preferably connected separately to the translationally moved component of the spindle drive. The two axles may be arranged at an acute angle to each other in the assembled state, so that the two rollers contact the column on which they roll on different or opposite sides.

The above mentioned refinement results in a very low-wear axial bearing, which at the same time effectively secures the translationally moved component of the spindle drive against rotation about the central axis. Due to the spatial arrangement of the column on which the two rollers roll, a relatively large lever arm is created by connecting the two rollers to the translationally moved component of the spindle nut. This allows high torques to be transmitted to the column.

According to another refinement, one of the two rollers is eccentrically pivoted.

This allows the pair of rollers to be mounted relatively easily and with zero backlash in relation to the column on which the pair of rollers rolls.

According to another refinement, at least one of the at least three columns has a cylindrical lateral surface.

The previously mentioned rollers therefore roll on a guide member with a round cross-section. This preferably results in a line-like contact surface between the wheels of the rollers and the corresponding column. Such a line-like contact surface is almost insensitive to contamination.

In a further refinement, the at least three columns are each detachably connected to the first and the second base plate.

On the one hand, this has the advantage that the housing is relatively easy to dismantle. On the other hand, the column, on which the translationally moved component of the spindle drive is guided according to the above-mentioned refinement, can be detached relatively easily and rotated around its longitudinal axis. Wear-related grooves on this column, which are generated over time due to the rollers rolling on the column, can thus be eliminated several times by rotating the column without having to replace the entire column. The backlash-free position of the rotation lock of the translationally moved component of the spindle drive can thus be restored extremely easily and economically.

Depending on the space and stiffness requirements, the housing may also comprise more than three columns, e.g. at least four, at least five or at least six columns.

In a further refinement, a spacer element is arranged between an end face of at least one of the at least three columns and the first or second base plate.

In this way, differences in height or length between the individual columns can be compensated. This simple measure allows the flatness of the two base plates to be produced very accurately, cost-effectively and, above all, without reworking. This is particularly advantageous when more than three columns are used, as this results in a static overdetermination in the housing construction. A washer or shim can be used as a spacer element, for example.

In a further refinement, the housing further comprises a casing surrounding the at least three columns.

This serves in particular to meet the safety-related requirements of such a press, since it should be ensured that all movable, force-transmitting components of the drive train are protected against intervention. For this purpose, a cladding (here generally referred to as "casing") can be mounted around the columns with little technical effort. It is advantageous if the casing is designed in two parts to ensure good accessibility for service and maintenance purposes.

It goes without saying that the features mentioned above and those yet to be explained below can be used not only in the combination indicated in each case, but also in other combinations or on their own, without leaving the spirit and scope of the present disclosure.

DESCRIPTION OF PREFERRED EMBODIMENTS

Figure 1:
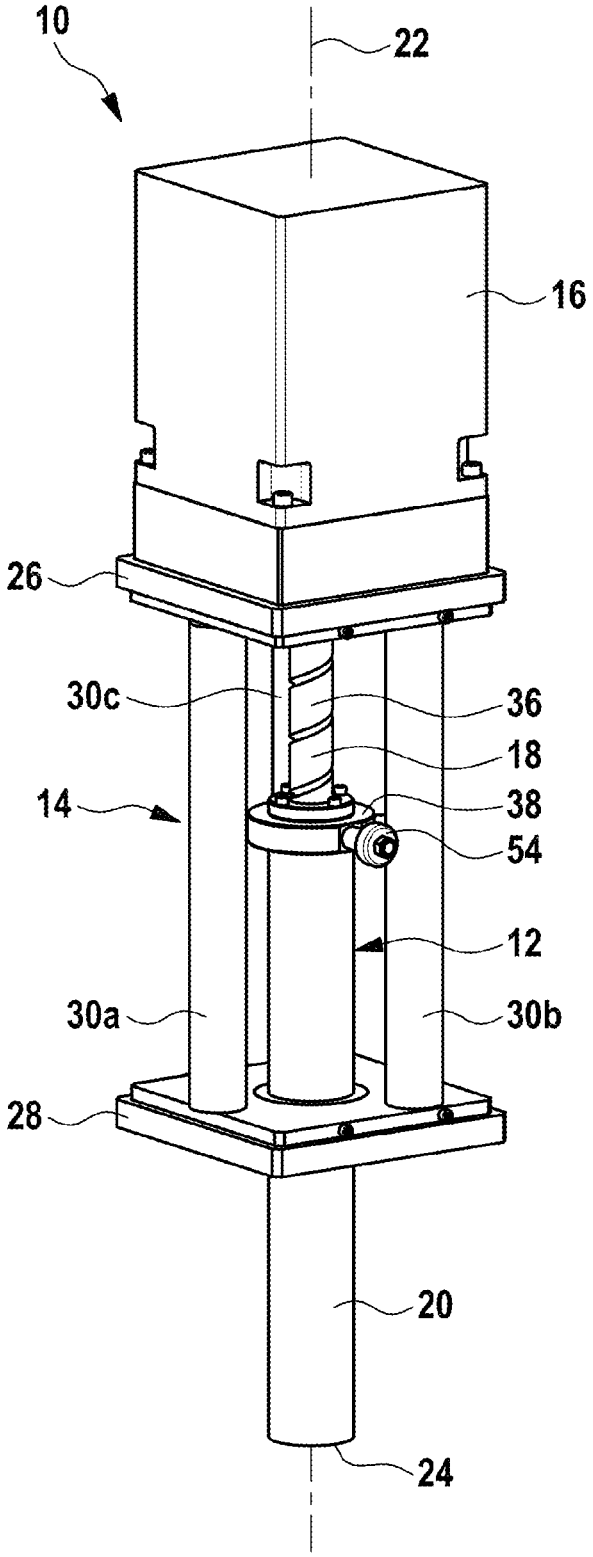
FIG. 1 a perspective view of a press according to a first embodiment.
Figure 2:
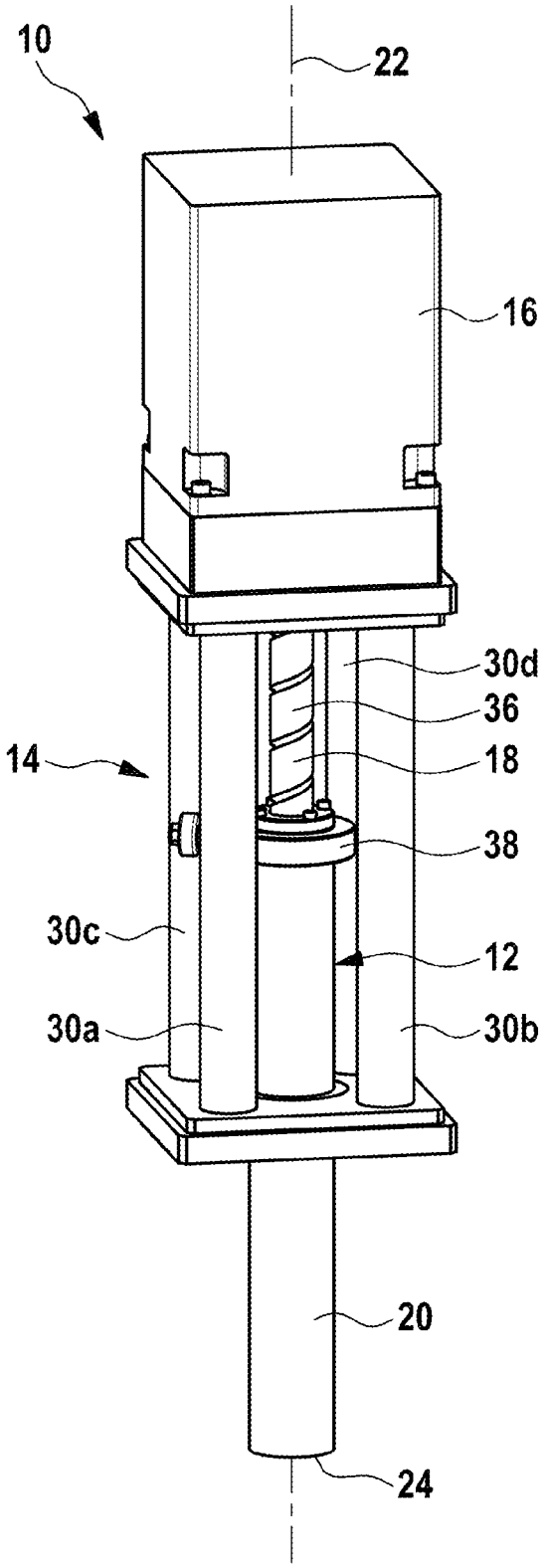
FIG. 2 a perspective view of the press according to a second embodiment.

FIGS. 1 and 2 show two embodiments of a press, each in a perspective view. The press in its entirety is denoted therein with reference numeral 10.

The press 10 comprises a drive train 12 and a housing 14. The housing 14 surrounds at least parts of the drive train 12. The individual components of the drive train 12 are supported by the housing 14 or are directly or indirectly attached or mounted on it.

The drive train 12 includes a motor 16 and, in this embodiment, a spindle drive 18, via which the motor 16 is coupled with a press ram 20. The motor 16 is preferably designed as an electric motor.

During operation, the motor 16 generates a rotational movement around a central axis 22 of the press 10. This rotational movement is converted by means of the spindle drive 18 into a translational movement of the press ram 20 along the central axis 22. Depending on the direction of rotation of the motor 16, the press ram 20 can thus be moved along the central axis 22 out of the housing 14 (downwards in the drawing) for pressing and into the housing 14 (upwards in the drawing) for releasing the workpiece.

A press plunger 24 is preferably arranged at the lower end face of the press ram 20, which press plunger contacts the workpiece to be processed during the press process. This press plunger 24 can either be designed integrally with the press ram 20 or be detachably connected to it.

The housing 14 comprises two base plates 26, 28, which are kept permanently spaced by several columns 30*a*, 30*b*, 30*c*. The base plate 26 is referred to as the first base plate in the present case. The base plate 28 is referred to as the second baseplate in the present case.

The two base plates 26, 28 are preferably arranged parallel to each other. The columns 30*a*-30*c* preferably extend orthogonally to the two base plates 26, 28, i.e. parallel to the central axis 22. However, this does not necessarily have to be the case. The columns 30*a*-30*c* can also be aligned at an acute angle to the base plates 26, 28, i.e. transversely (non-parallel) to the central axis 22. Preferably, the columns 30*a*-30*c* are each at the same distance from the central axis 22.

The motor 16 is mounted on the top side of the first base plate 26 which faces away from the columns 30*a*-30*c*. The press ram 20, on the other hand, projects downwards from the second base plate 28 on the underside of the second base plate 28 which faces away from the columns 30*a*-30*c*. The drive train 12 is thus passed through the housing 14 consisting of the base plates 26, 28 and the columns 30*a*-30*c*. For this purpose the first base plate 26 comprises a first opening 32 and the second base plate 28 comprises a second opening 34 (see FIG. 3). Parts of the motor 16 and/or of the spindle drive 18 protrude through the first opening 32. The motor 16 is therefore connected to the spindle drive 18 via or through the first opening 32. On the opposite side of the housing 14, parts of the spindle drive 18 and/or of the press ram 20 protrude through the second opening 34. In the embodiment shown here, only the press ram 20 is passed through the second opening 34. However, it is also conceivable that parts of the spindle drive 18 are passed through the first opening 32 and the press ram 20 is attached to the spindle drive 18 only below the second base plate 28.

The second embodiment shown in FIG. 2 differs from the first embodiment shown in FIG. 1 by the number of columns 30 arranged in the housing 14. In the second embodiment, the housing 14 comprises a total of four columns 30*a*-30*d*. The previously mentioned construction of the press 10 is otherwise the same.

In both embodiments, the columns 30*a*-30*c* and 30*a*-30*d* surround parts of the drive train 12, in particular the spindle drive 18, so that the lateral surface 33 of the first opening 32 and the lateral surface 35 of the second opening 34 are at a smaller distance from the central axis 22 than the three or four columns 30*a*-30*c* or 30*a*-30*d*. The two openings 32, 34 are preferably aligned with each other. The two openings 32, 34 can, but do not necessarily have to be the same size. The two openings 32, 34 are preferably each symmetrical to the central axis 22.

According to both embodiments shown in FIGS. 1 and 2, spindle drive 18 is designed as a spindle drive with driven spindle. The spindle drive 18 comprises a spindle 36, which is rotationally driven by the motor 16. In addition, the spindle drive 18 comprises a spindle nut 38, which is mounted on the spindle 36 and is moved translationally along the central axis 22 during the rotation of the spindle 36. To ensure this translational movement, the spindle nut 38 is secured against rotation around the central axis 22, as explained in detail below. The spindle nut 38 is connected to the press ram 20 so that the press ram 20 moves together (synchronously) with the spindle nut 38 along the central axis 22.

In the two embodiments shown here, the spindle 36 is the component of the spindle drive 18 that is rotationally driven by the motor 16 and the spindle nut 38 is the translationally moved component of the spindle drive 18. In principle, however, this could also be done the other way round, so that the spindle nut 38 is the component that is rotationally driven by the motor 16 and the spindle 36 is the translationally moved component. In such a case, the spindle 36 would then have to be secured against rotation around the central axis 22. In addition, the arrangement would have to be reversed so that the spindle nut 38 is connected to the motor 16 and the spindle 36 is connected to the press ram 20. In such a case, the spindle 36 itself could also be designed as a press ram 20 or at least be integrally connected to it.

Figure 3:
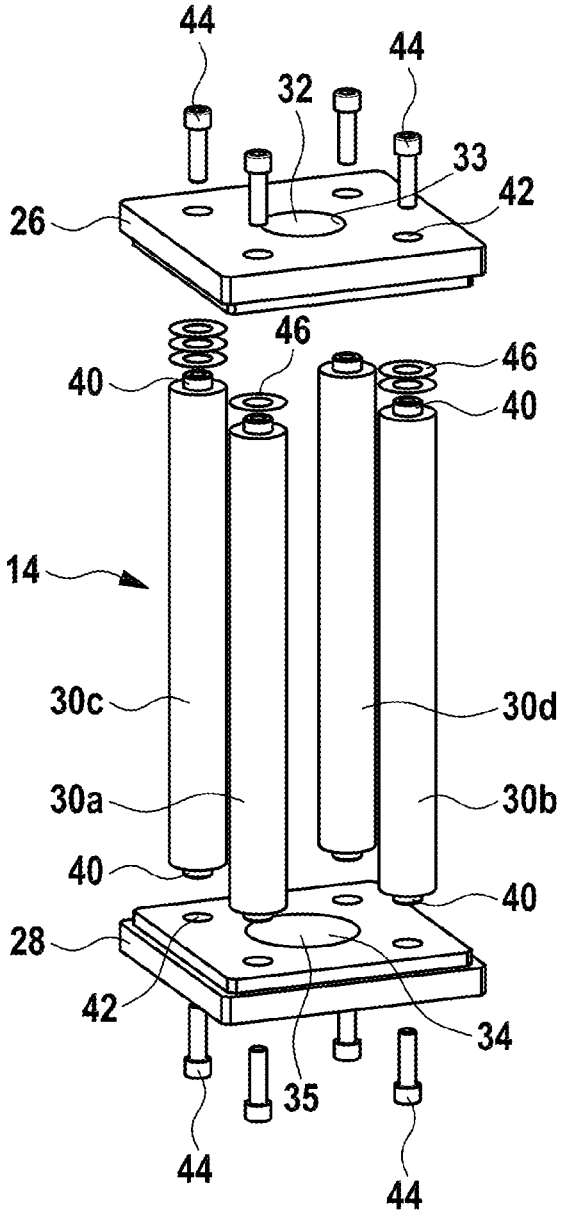
FIG. 3 an exploded view of a housing of the press shown in FIG. 2.

FIG. 3 shows an exploded view of the housing 14 according to the second embodiment of the press 10 shown in FIG. 2. This exploded view shows particularly how the base plates 26, 28 are attached to the columns 30*a*-30*d*.

The columns 30*a*-30*d* are preferably standardized precision steel shafts. The columns 30 can be designed as solid shafts or hollow shafts. If hollow shafts are used, cables, hoses, etc. can be routed with little effort through the hollow bores inside the columns 30. The columns 30 are preferably hardened and ground.

The columns 30*a*-30*d* are preferably each detachably connected to the base plates 26, 28. In the embodiment shown here, the columns 30*a*-30*d* each comprise a centering collar 40 on both sides which centering collars are inserted into a corresponding bore 42 provided in the base plate 26 and in the base plate 28. In the example shown here, screws 44 are used for connection, which screws engage in the corresponding internal threads provided inside the columns 30.

Differences in height or length of the individual columns 30*a*-30*d* are preferably compensated by spacer elements 46, which can be arranged between the columns 30*a*-30*d* and the first base plate 26 and/or between the columns 30*a*-30*d* and the second base plate 28. Such a height or length compensation is particularly advantageous for a design with four or more columns 30, since this notoriously results in a static overdetermination. Shims or washers, for example, can be used as spacer elements 46.

A misalignment of the two base plates 26, 28 would lead to an alignment error between the drive train 12, particularly of the spindle drive 18, and of the housing 14 or of the columns 30. An alignment error would have a direct effect on the running characteristics of the spindle drive 18 and considerably reduce the service life of the system. With conventional housings made of extruded aluminum profiles or tubular steel constructions, it is technically very complex and costly to meet these requirements for the flatness of the base plates 26, 28. However, this is where the advantage of the housing concept of the press 10 becomes apparent. Since the base plates 26, 28 are detachably connected to the columns 30*a*-30*d*, a simple flatness measurement can be carried out. For this purpose, the pre-assembled housing 14 is placed on a measuring table, for example with the second base plate 28. The height dimensions can be determined at the screw points of the first base plate 26 by means of a height measuring instrument. The dimensional deviation in relation to the maximum dimension can then be compensated with the aid of the spacer elements 46.

Figure 4:
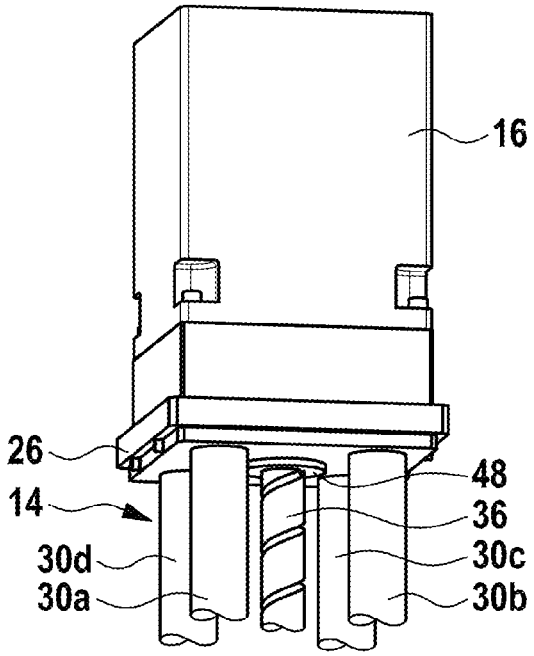
FIG. 4 a first truncated detailed view of the press shown in FIG. 2.
Figure 5:
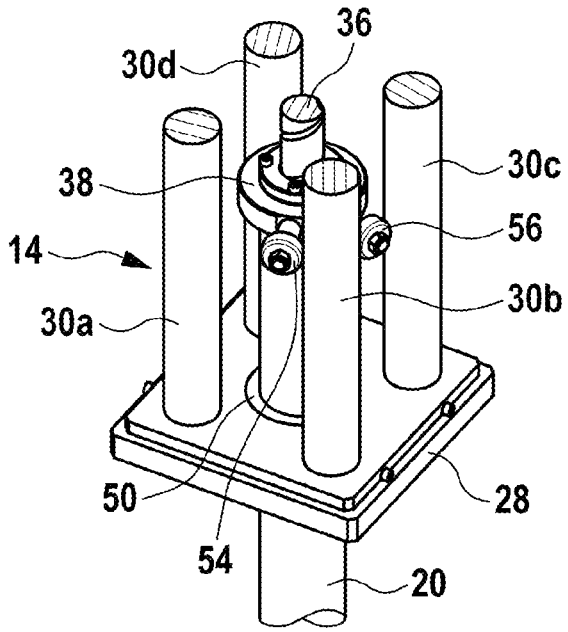
FIG. 5 a second truncated detailed view of the press shown in FIG. 2.
Figure 6:
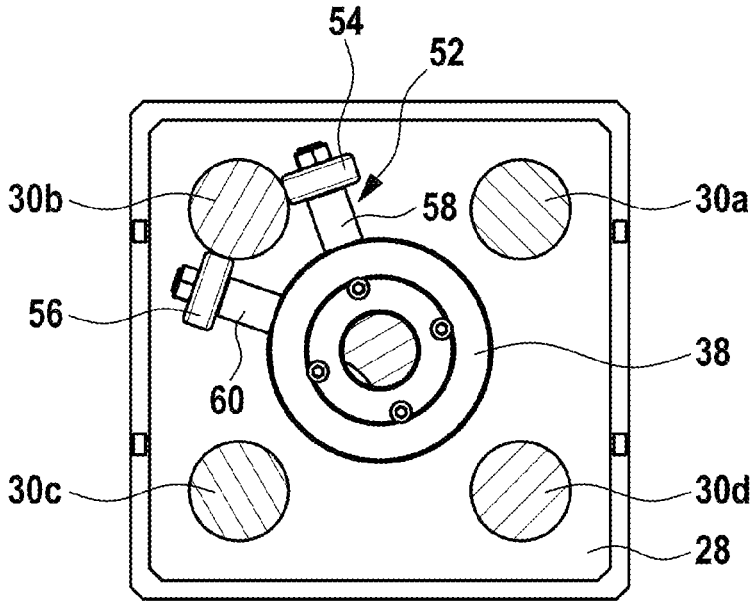
FIG. 6 a top view from above of the press shown in FIG. 5.

FIGS. 4-6 show further details of the housing 14 as well as the type of arrangement of the drive train 12 within the housing 14. As can be seen in particular in FIG. 4, the spindle 36 is guided axially in the first base plate 26 by a guide member 48. The guide member 48 can be an axial or radial bearing, for example. The press ram 20 is guided axially in the second base plate 28 by a guide member 50 (see FIG. 5). The second guide member 50 is preferably designed as a linear bearing.

FIGS. 5 and 6 furthermore show a possible implementation of a guide 52, with the aid of which the spindle nut 38 is guided translationally and secured against rotation about the central axis 22. The guide 52 comprises two rollers 54, 56 which roll on the column 30*b*. The column 30*b* is thus used as a guide member for translational guidance and at the same time as rotation lock of the spindle nut 38.

Figure 7:
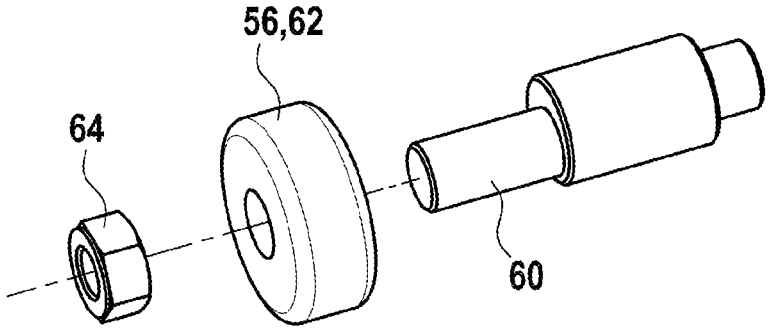
FIG. 7 an exploded view of a roller which can be used in the press.

Each of the two rollers 54, 56 is connected to the spindle nut 38 via an axle 58, 60. One of the two rollers 54, 56, in this case roller 56, is eccentrically pivoted. Details of this eccentric bearing are shown in FIG. 7. As can be seen in FIG. 7, the axle 60 has an eccentric on which the wheel 62 of the roller 56 is mounted and is mounted by means of a nut 64. The eccentric bearing of the wheel 62 of the roller 56 enables easy mounting of the two rollers 54, 56 on the column 30*b*. The eccentric bearing makes it relatively easy to establish a connection with zero backlash between the roller 56 and the column 30*b*. Due to the spatial arrangement of the column 30*b*, a relatively large lever arm is obtained. Thus, high torques can be transmitted.

In the present case, the rollers 54, 56 are connected to the spindle nut 38 as shown. It is understood, however, that if a spindle drive with a driven spindle nut is used, the spindle of the spindle drive can be translationally guided and secured against rotation in the same way.

The columns 30*a*-30*d* are preferably cylindrical. The two rollers 54, 56 thus roll on a cylindrical or round guide member. This preferably results in a line-like contact surface between the rollers 54, 56 and the column 30*b*, which is insensitive to contamination.

Figure 8:
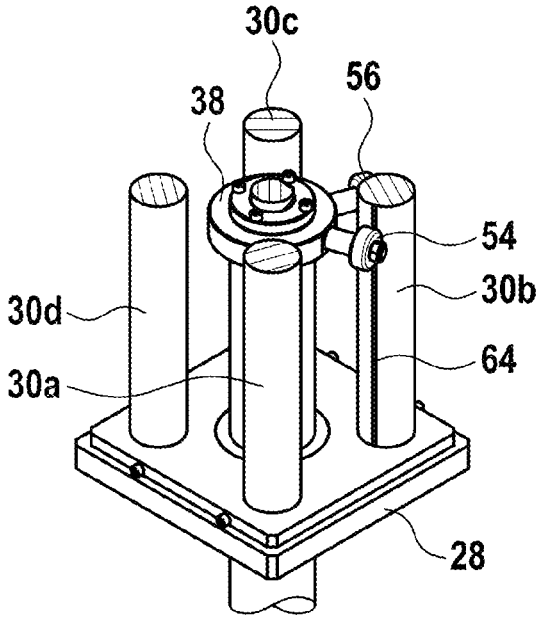
FIG. 8 a third truncated detailed view of the press shown in FIG. 2 in a first state.
Figure 9:
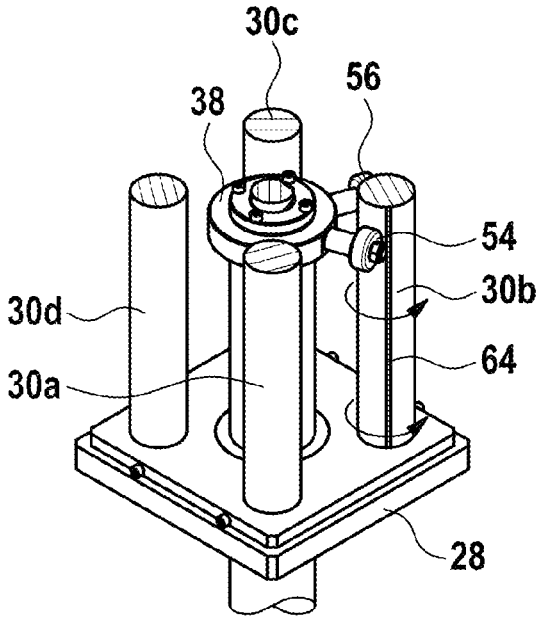
FIG. 9 the view of the press shown in FIG. 8 in a second state.
Figure 10:
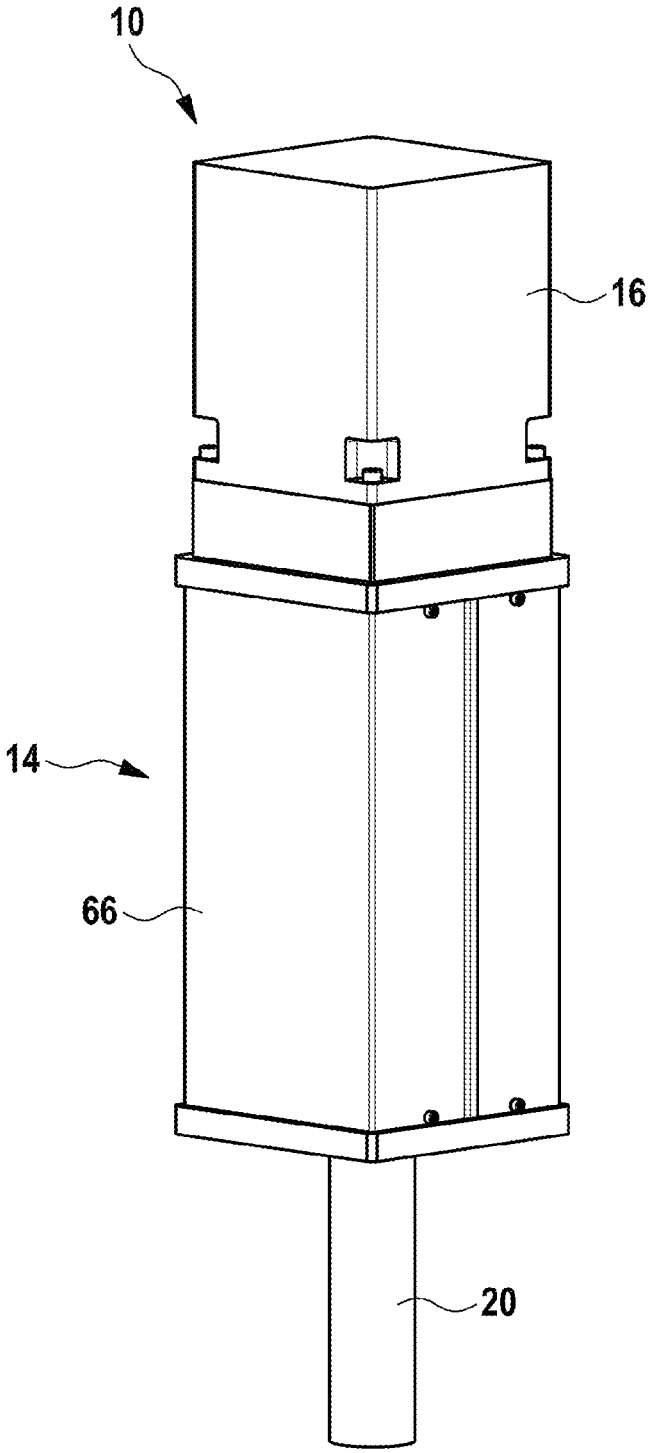
FIG. 10 a perspective view of an embodiment of a casing of the press.

Over time, however, this may result in grooves on the column 30*b*. These grooves are exemplarily shown in FIGS. 8 and 9 and marked with the reference numeral 64. Since the columns 30*a*-30*d* can be detached from the two base plates 26, 28, as mentioned above, the columns 30*a*-30*d* can be turned relatively easily around their longitudinal axis. In this way the grooves 64 can be rotated further clockwise or counterclockwise so that the grooves 64 then no longer interfere with the guidance of the rollers 54, 56 on column 30*b*. This procedure is exemplarily shown in FIG. 9.

In order to meet the safety requirements for such a press 10, it should be ensured that all movable, force-transmitting components of the drive train 12 are protected against intervention. For this purpose, the housing 14 may comprise a cladding/casing 66 surrounding the columns 30*a*-30*d*. It is advantageous for this cladding/casing 66 to be designed in at least two parts to allow good accessibility for service and maintenance purposes.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A press, comprising:

a drive train comprising a motor and a press ram;

a housing comprising a first base plate, a second base plate and at least three columns arranged between the first and second base plates, wherein the columns connect the first and second base plates to one another and keep them spaced apart, wherein a first opening is arranged in the first base plate and a second opening is arranged in the second base plate, wherein at least a part of the motor is arranged on a first side of the first base plate facing away from the columns and at least a part of the press ram is arranged on a second side of the second base plate facing away from the columns, and wherein the motor and the press ram are interconnected through the first opening and the second opening, wherein the press ram protrudes through the second opening out of the second base plate, and wherein a press plunger is arranged at an end face of the press ram or the press plunger is formed by the end face, the end face being disposed on the second side of the second base plate, wherein the drive train further comprises a spindle drive having a spindle and a spindle nut, wherein the spindle drive comprises a component which is rotationally driven by the motor and a translationally moved component which is coupled to the rotationally driven component and which is translationally guided and secured against rotation on at least one of the at least three columns by means of a guide, wherein either (i) the spindle is the rotationally driven component and the spindle nut is the translationally moved component, or (ii) the spindle is the translationally moved component and the spindle nut is the rotationally driven component, wherein the guide comprises a bearing, and wherein the bearing comprises two rollers which are configured to roll on the at least one of the at least three columns, wherein the two rollers are each connected to the translationally moved component.

2. The press according to claim 1, wherein the at least three columns each extend along a longitudinal axis that is oriented orthogonally to the first base plate and the second base plate.

3. The press according to claim 1, wherein at least a part of the drive train is arranged between the first and second base plates and is surrounded by the at least three columns.

4. The press according to claim 1, wherein the first opening and the second opening are aligned with each other and extend along a central axis, wherein a first lateral surface of the first opening and a second lateral surface of the second opening are each arranged at a first distance from the central axis and the at least three columns are each arranged at a second distance from the central axis, the first distance being smaller than the second distance.

5. The press according to claim 1, wherein one of the two rollers is eccentrically pivoted.

6. The press according to claim 1, wherein at least one of the at least three columns has a cylindrical lateral surface.

7. The press according to claim 1, wherein the at least three columns are each detachably connected to the first base plate and second base plate.

8. The press according to claim 1, wherein the at least three columns include at least four columns.

9. The press according to claim 1, wherein a spacer element is arranged between an end face of at least one of the at least three columns and the first or second base plate.

10. The press according to claim 1, wherein the housing further comprises a casing surrounding the at least three columns.

* * * * *